United States Patent [19]

McCullagh

[11] Patent Number: 5,029,600

[45] Date of Patent: Jul. 9, 1991

[54] ACCESSORY METHOD AND APPARATUS FOR AUTOMATIC SWIMMING POOL CLEANERS

[76] Inventor: Patrick M. McCullagh, No. 10, Robert St., Willoughby 2068, Sydney, Australia

[21] Appl. No.: 366,767

[22] Filed: Jun. 14, 1989

[30] Foreign Application Priority Data

Jun. 14, 1988 [ZA] South Africa ..... 88/4230
Aug. 8, 1988 [ZA] South Africa ..... 88/5805

[51] Int. Cl.[5] ..... E04H 4/16

[52] U.S. Cl. ..... 137/1; 210/169; 15/1.7; 134/167 R

[58] Field of Search ..... 137/1; 210/169; 15/1.7; 134/167 R

[56] References Cited

U.S. PATENT DOCUMENTS 4,642,833 2/1987 Stoltz et al. ..... 15/1.7
4,675,921 6/1987 Jean-Jacques ..... 15/1.7 X
4,686,728 8/1987 Rawlins ..... 210/169 X

*Primary Examiner*—John Rivell
*Attorney, Agent, or Firm*—Arnold, White & Durkee

[57] ABSTRACT

This invention relates to an accessory method and apparatus for raising and sinking a suction hose, connected to a submerged swimming pool cleaner, by altering the buoyancy of the hose. Alterations of buoyancy of the hose are obtained by utilizing the flow of water or other liquid induced within the hose by the swimming pool filter pump, to alter the volume of air within a buoyancy chamber attached to the hose thereby inducing a negative buoyancy when the pump is switched off, and a positive buoyancy when the pump is in operation. The invention extends to a valve means which can be manipulated to induce buoyancy changes of the hose as required.

18 Claims, 7 Drawing Sheets

ACCESSORY METHOD AND APPARATUS FOR AUTOMATIC SWIMMING POOL CLEANERS

INTRODUCTION

THIS INVENTION relates to an accessory method and apparatus for use together with submerged cleaning devices operating by suction through a suction hose.

BACKGROUND TO THE INVENTION

Typically the invention applies to automatic swimming pool cleaners. One of the difficulties experienced with automatic swimming pool cleaners, is that the suction hose between the cleaning head and the pump trails the cleaning head around the pool, and for the most part of its length floats on the surface. For a person then to use the pool, he must either put up with the hose obstructing the surface area of the pool, or remove it. Furthermore, even when the automatic pool cleaner is not in operation, the hose remains floating in the pool and is visually obtrusive.

OBJECT OF THE INVENTION

It is an object of this invention to provide a method and apparatus for alleviating this position.

SUMMARY OF THE INVENTION

In accordance with this invention there is provided a method of raising and sinking a suction hose connected to a submerged suction head in a liquid, comprising providing a buoyancy compartment to the hose, weighting the hose to allow it to sink if the compartment buoyancy is reduced by reducing the volume of air therein, and to float if the compartment buoyancy is increased by increasing the volume of air therein, and, utilising the suction induced liquid flow in use in the hose to selectively cause a pressure differential to be applied to the compartment to alter its buoyancy by altering the volume of air therein and so selectively raise and sink the hose.

A further feature of the invention provides for the water flow to cause the required pressure differential by the location of a variable volume buoyancy compartment in the length of the interior of the hose, and connecting the compartment to atmosphere, and, cutting off the water flow in the hose, or alternately switching the buoyancy compartment connection from atmosphere to the hose at a position downstream of the compartment or both.

The cessation of water flow may be caused by switching the suction pump off, or by operating a valve to divert the suction force of the pump from the automatic pool cleaner line.

The switching of the compartment connection between the atmosphere and the hose may be achieved by manual connection of a flexible hose means, and also by releasably mounting the compartment connection to a fixed bracket above the water. The connection point to the hose in both cases is provided with a valve or closure flap to seal the hose when not connected.

There is alternatively provided for the switching of the buoyancy compartment connection between atmosphere and the hose to be achieved by use of a valve means, and preferably a valve means which is automatically resettable to cause the hose to float when the suction flow is switched on after a period in which it was switched off. Such a valve may be located in the hose itself and operated against biasing to connect the compartment from atmosphere to the hose interior, with the pressure differential between atmosphere and hose interior holding the valve in this position, unless the water flow ceases, in which case the valve under biasing force remakes the connection from the hose interior to atmosphere, and refloats the hose once the water flow resumes thereafter.

This invention extends to an apparatus for use in this method, including a collapsible or variable volume compartment with atmospheric and hose connections with or without valves, and to sections of hose fitted with such apparatus. Whilst the invention is described in use with a flexible hose and in the interior of the main suction hose, it will be apparent to one skilled in the art that embodiments of the invention will operate with the flexible buoyancy compartment having the same connection to atmosphere and to the interior of the main hose as described here, but located inside a rigid compartment or series of compartments which are attached alongside the main suction hose, the interiors of these rigid compartments being connected through parts to the interior of the main suction hose.

It will also be apparent to one skilled in the art that embodiments of the invention will also operate as rigid buoyancy compartments attached to the main suction hose, the contents of these rigid compartments being controlled by means of appropriate valves to be either predominantly water or air, the buoyancy depending on the contents.

BRIEF DESCRIPTION OF THE DRAWINGS

Preferred embodiments of the invention are described below by way of example only, and with reference to the accompanying drawings, in which.

DETAILED DESCRIPTION OF THE DRAWINGS

Figure 1:
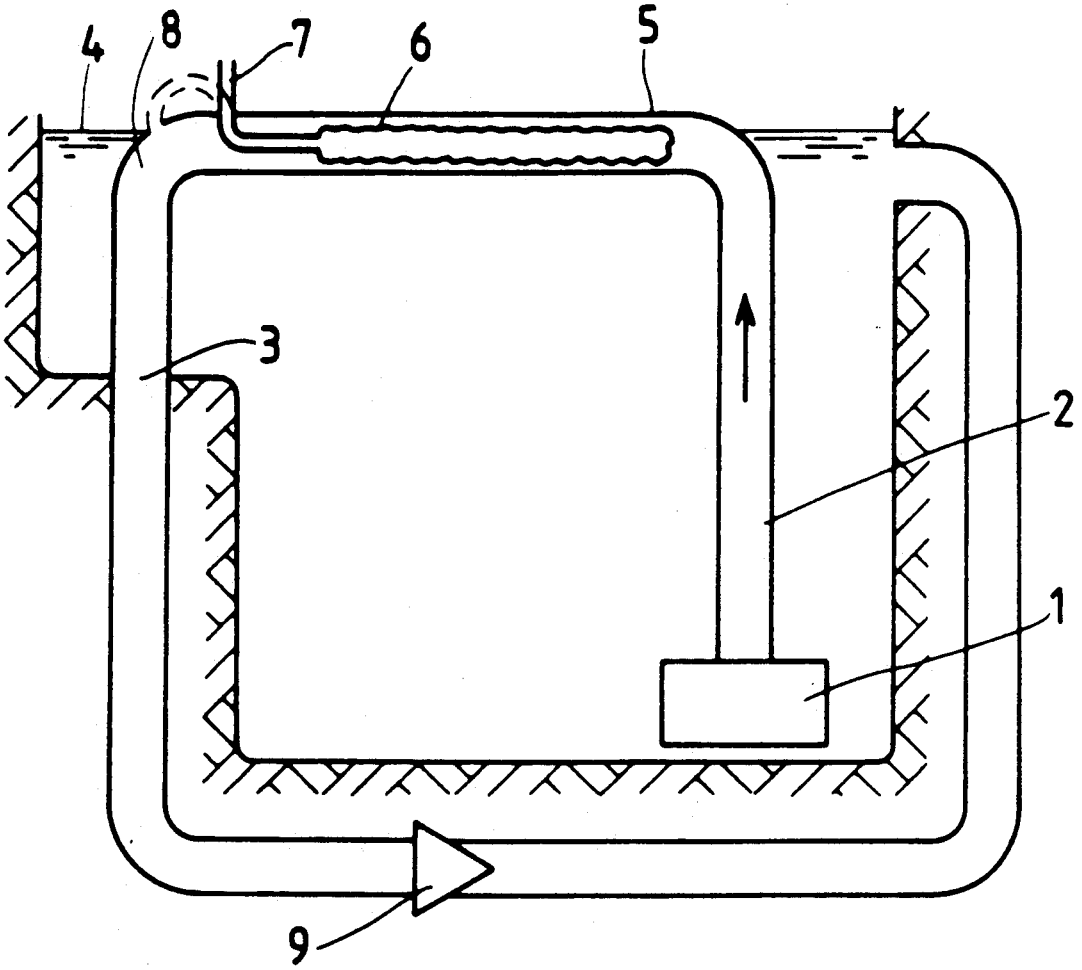
FIG. 1 is a diagrammatic functional view of the operation of the method with a swimming pool cleaner.
Figure 2:
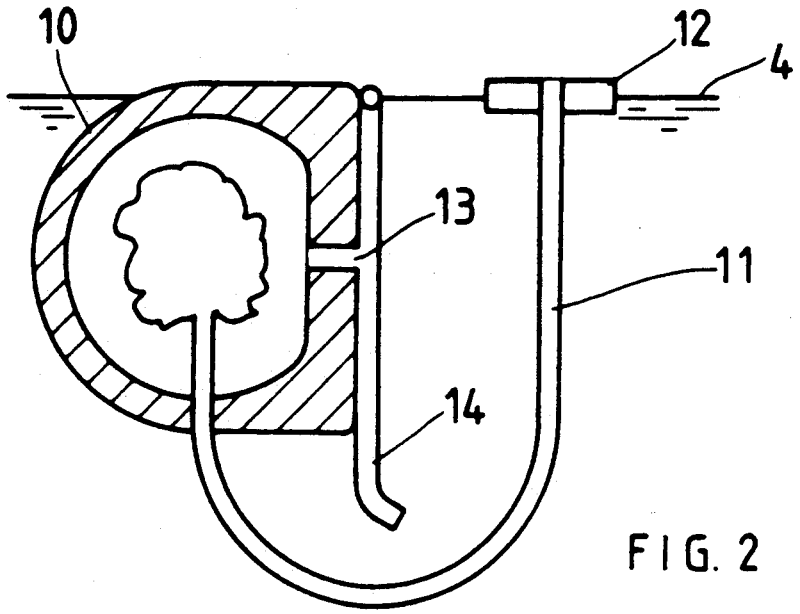
FIG. 2 is a cross-sectional functional view of the apparatus of FIG. 1.

Referring to FIGS. 1 and 2, a swimming pool cleaner suction head (1) is connected by a suction hose (2) to an inlet (3) to a filter pump (9), and is located in a swimming pool with a water level (4). The hose for a section of its length runs along the top of the surface in its conventional position in use (5). Located within the hose is an elongated collapsible bladder compartment (6) with a flexible tubular connection (7) extending to atmosphere, and being connectible to a position (8) to communicate the interior of the bladder with the interior of the hose, at a position downstream of the bladder within the hose.

FIG. 2 shows the hose in cross-section, the bladder compartment indicated by numeral (10), with the bladder compartment connection (11) secured to a float (12)

and being connectible to the hose connection (13) by opening a spring loaded closure flap (14) which normally seals the connection opening off from water between connections.

The hose is weighted so that with the bladder open to atmosphere and containing air to its full volume, the hose will float on the surface, but if the bladder should collapse and lose air volume, the hose will sink.

When the pool cleaner is in operation, with the bladder connected to atmosphere at the float (12), the atmospheric pressure at the water level extends to the bladder and the bladder is maintained at its full volume, since the water pressure in the hose but external to the bladder is reduced relative to atmosphere by the water flow therein. It will also be appreciated that as the water flows through the hose, frictional losses occur at the side walls of the hose, so that the absolute pressure inside the hose is lower downstream than it is upstream.

Should a person wish the hose now to sink, the closure flap (14) is opened and the float (12) is placed over the opening (13) in the hose where it remains attached due to the pressure differential. The bladder compartment is now exposed to the pressure at the position (8) of the hose, which is lower than the pressure at all positions along the length of the bladder. The bladder thus collapses and air is expelled from it into the hose. The amount of air in question is not considerable, and the air bubbles will not be a major problem for the suction pump. With the collapse of the compartment, the hose sinks.

For the hose to be floated, the bladder is connected to atmosphere once again whereupon the pressure differential between atmosphere and the hose interior, as described above, will cause air to be drawn into the bladder and the hose will rise.

Alternatively, if the bladder is permanently connected to atmosphere, the hose may be sunk by switching off the water flow whereupon if the buoyancy of the floating section of the hose is arranged correctly, the bladder will tend to be positioned slightly below the water surface, and will therefore be subject to depth water pressure on the exterior of its walls. This water pressure will be greater than the atmospheric pressure in the interior of the bladder which will therefore be inclined to contract, thereby losing buoyancy and sinking further as a result. The sinking action will in turn increase the depth pressure on the exterior of the bladder, thereby causing further loss of air which results in further sinking. Restarting the water flow will recreate the pressure differential between the hose interior and atmosphere and re-inflate the bladder to float the hose. Automatic resetting to atmospheric connection is achieved through the release of the float (12) once the pressure differential ceases due to cessation of flow through the hose, whereupon the float (12) will be released from connection (13) and will rise to the surface.

Figure 3:
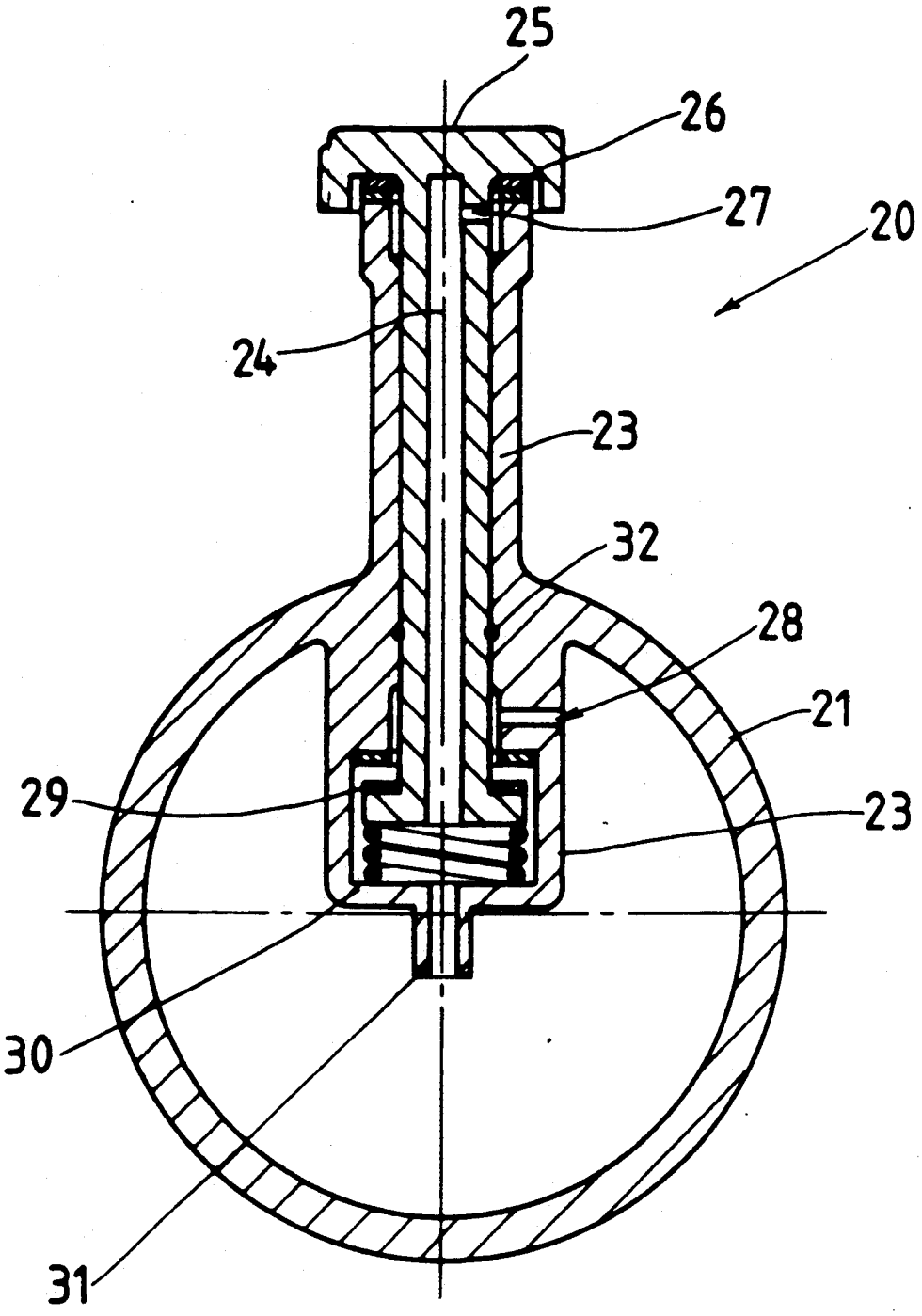
FIG. 3 is a cross-sectional view through a valve for use in the method of the invention.

Referring now to FIG. 3, a valve (20) is shown for use in the embodiment of FIG. 1 in connecting the buoyancy compartment (6) between atmosphere and the position (8) downstream of the compartment. The valve is located radially within the suction hose (21), and comprises a tube (23) with an axially slidable further tube (24) therein. The slidable tube (24) has an exterior top (25) by which the valve can be operated by sliding the tube (24) up and down within the outer tube (23). Sealing surfaces (26) are provided at the top so that with the inner tube pushed in, the interior of the tube (24) is closed to the exterior of the tube (23). An opening (27) is provided between the interior o tube (24) and atmosphere, this connection being made when the tube (24) is raised to free the seals (26) from each other.

A similar arrangement is provided at the bottom end of the valve, there being an opening (28) communicating between the interior of tube (23) and the interior of the hose (21). The opening (28) communicates with the interior of slidable tube (24) through its end face, which end face can be opened and closed by means of movement of the tube (24) to open and close seals (29). The tube (24) slides against compression spring biasing (30) between its end face and the end wall of the tube (23). The end face of the tube (23) has an opening (31) which is connected to the collapsible bladder compartment. A sliding seal (32) prevents flow along the cavity between the exterior of tube (24) and the interior of tube (23).

In use, with the tube (24) raised, the bladder compartment is open directly through the axial connection (31) and the length of the tube (24) to the opening (27) to the atmosphere. When the tube (24) is pushed down by the top (25), the seals (26) engage and the atmospheric connection is broken. At the same time the seals (29) are opened, and the collapsible compartment is connected through its connection (31) and the tube (23) to the opening (28) to the interior of the hose (21). Pushing the tube (24) down to this position is done against the spring biasing (30). The pressure differential between the interior and immediate exterior of the hose (21) will allow the valve to remain in this position whilst water flows, but as soon as the water flow ceases, the pressure differential will be lost and the spring (30) will operate to switch the valve (24) back to atmospheric connections. This will refloat the hose when flow along the hose (21) is thereafter resumed.

Figure 4:
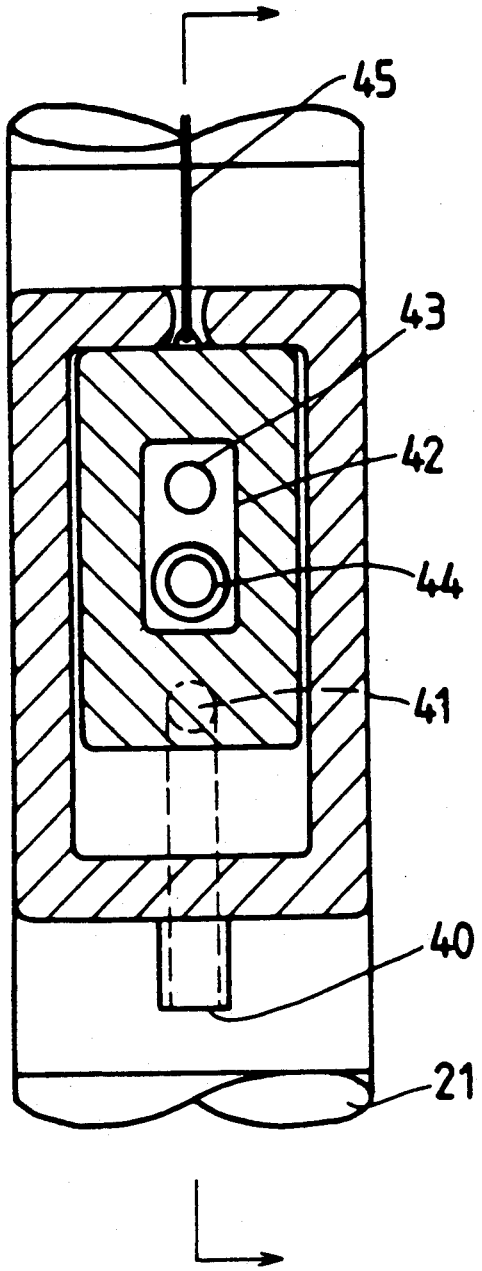
FIGS. 4 & 5 are front and side front sectional views through an alternate valve to that of FIG. 3.
Figure 5:
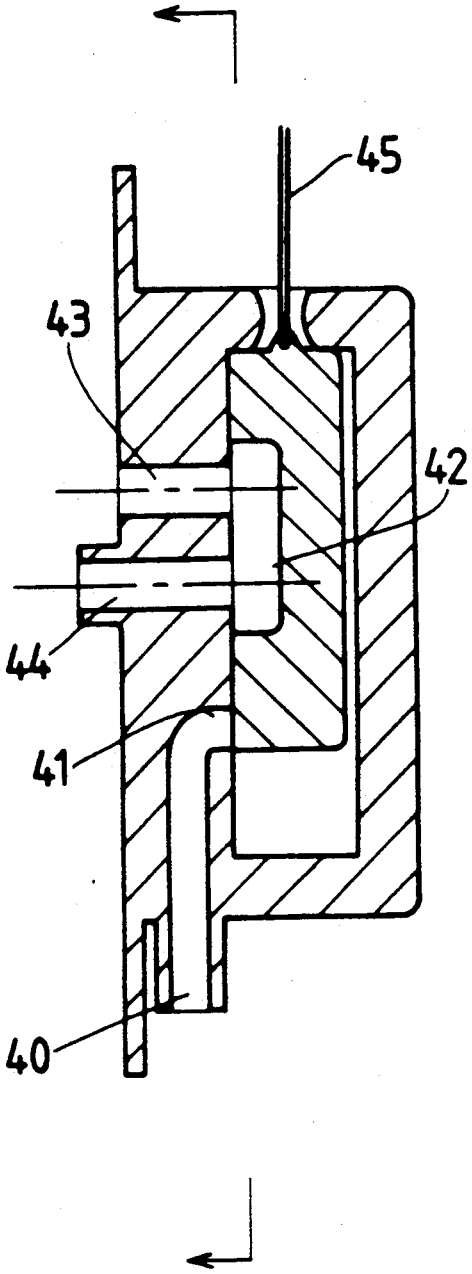

Referring now to FIGS. 4 and 5, an alternate embodiment to that of FIG. 3 is shown. This embodiment is arranged to be located to the side of the hose, and has a rectangular body with a connection (44) from the bladder (6) through a passage (42) in a slidable block to one of two openings (41) and (43), depending on the position of slide of the block (42). The opening (43) is to the interior of the hose, and the opening (41) is to atmosphere via a connection (40).

In use, the block is operable to slide to connect the bladder compartment (6) through connection (44) either to the atmospheric opening (40) or the hose interior (43), by operation of a drawstring (45) which is conveniently secured to a float but not in a taut manner.

The operation of the slide to the different positions will cause the hose to float or sink as described above. In this case however the automatic resetting is achieved by the weight of the slide itself which in the absence of a pressure differential, will drop to the bottom of its slide position thus connecting the bladder compartment to atmosphere when the suction from water flow is cut off, thus releasing the suction hold on the block in the position in which it connects the bladder compartment to the hose interior.

Figure 6:
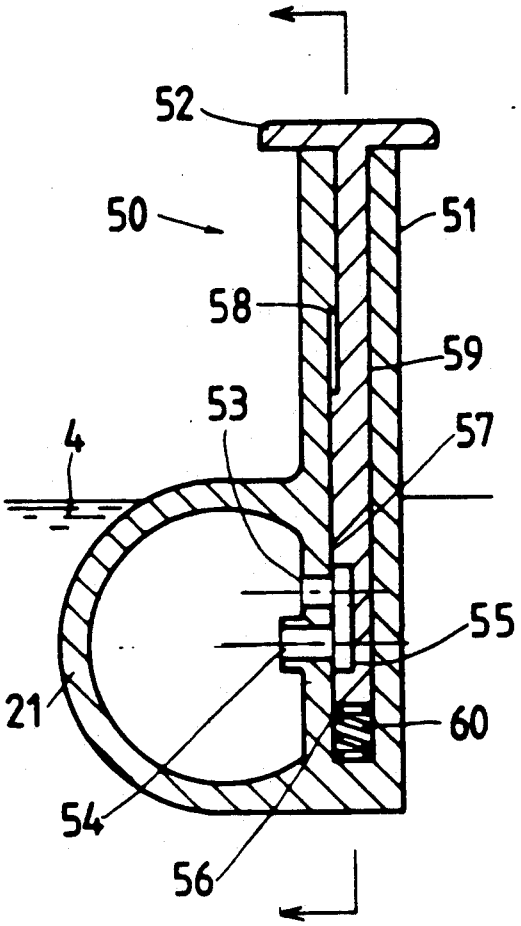
FIGS. 6 & 7 are front and side sectional views through an alternate valve to that of FIG. 3; and, FIG. 8 is a diagrammatic functional view of an embodiment of the invention having an external rigid buoyancy compartment.
Figure 7:
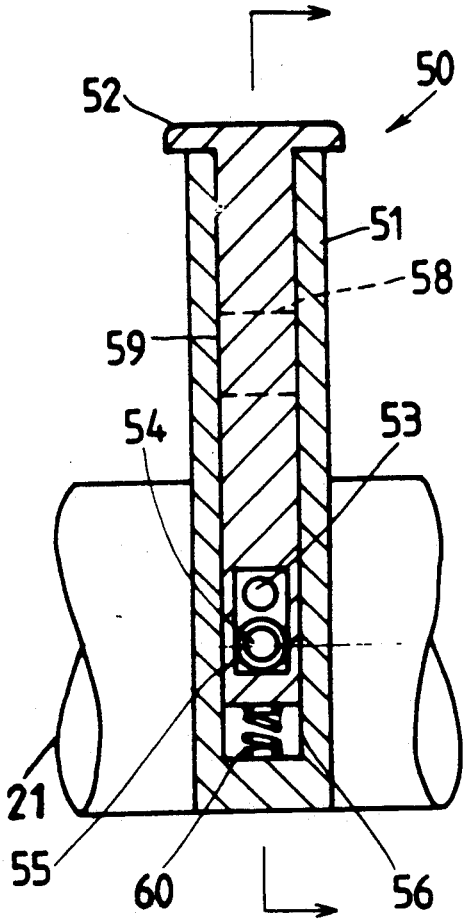

Referring to FIGS. 6 and 7 , an alternative embodiment to that of FIG. 3 is shown. A valve (50) is shown for use in connecting the buoyancy compartment (6) either to atmosphere or to the position (8) downstream of the bladder compartment (6). The valve is located alongside and integral with the suction hose (21), and comprises a rectangular tube (51) with an axially slidable block (52) therein. The rectangular tube (51) is open to atmosphere at its top end and has a connection (53) to the interior of the hose (21) and a connection (54)

to the collapsible buoyancy bladder (6). The sliding block (52) has a rectangular cavity (55) shaped such that when the block (52) is at its lowest position against the locating step (56) at the lower end of the rectangular tube (51), the collapsible bladder (6) is linked through the connection (54) to the rectangular tube (51) and then through the cavity (55) into the sliding block (52) to the connection (53) to the interior of the hose (21). The block (52) will be held in this position by the friction force of its connecting surface (57) against the wall of the rectangular tube (51), this friction force being caused by the pressure differential between the interior of the main hose (21) and atmosphere. When the sliding block (52) is at its uppermost position against the upper locating step (58), the collapsible bladder (6) is open to atmosphere via the connection (54) and the gap (59) between the sliding block (52) and the rectangular tube (51). The spring (60) ensures that when there is no flow in the hose (21), the block (52) will naturally move upwards against the locating step (58). Should a person wish to sink the hose (6) while the pool cleaner is operating, the sliding block (52) is pushed downwards by force on its upper end. The resultant connection between the bladder (6) and the point (8) in the hose (2) downstream of the bladder (6), as described above, will sink the hose (21). Raising of the hose to the surface is achieved by the raising of the sliding block (52) by upward force on it, in order to make the connection between the bladder (6) and atmosphere as described above. Automatic resetting of the sliding block to its upper position occurs in the absence of flow through the hose (21) as a result of the upward force supplied by the compression spring (60).

Figure 8:
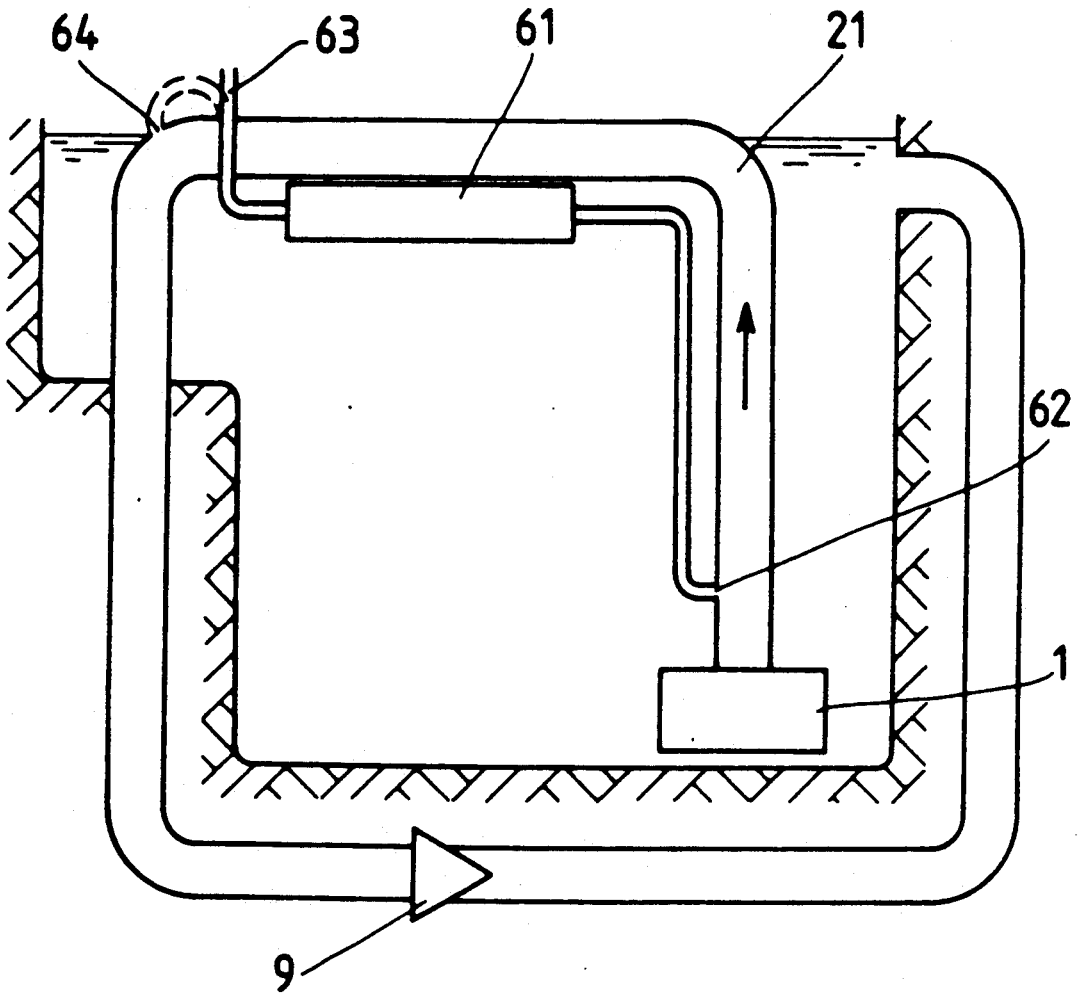

Referring to FIG. 8, along the length of a main suction hose (21) is attached a rigid flotation chamber having its upstream end connected to the interior of the hose (21) at a point (62) near the cleaning head (1). A connecting tube 63) communicating with the downstream end of the chamber (61) is able to be directed either to atmosphere or to connect with a position (64) downstream of the chamber (61). The weighting of the hose (21) is such that if the attached chamber (61) predominantly contains air, the resulting flotation force will be sufficient to raise the chamber (61) and attached hose (21) to the water surface, while if the chamber (61) contains predominantly water, the chamber (61) and attached hose (21) will sink.

When the pump (9) is operating and there is flow in the suction line (21), if the connecting tube (63) is directed to atmosphere by a person wishing to cause the hose (21) to float, air will be drawn through the connecting tube (63), through the chamber (61) towards the connection point (62), because of the pump induced pressure reduction in the hose (21). When the chamber (61) contains sufficient air, it will rise together with the hose (21). The size of the connection (62) is such that if the pump pressure is sufficient to cause air to be drawn into the hose (21) through the upstream connection point (62), then the amount of air flowing into the hose (21) will be insufficient to significantly impair the operation of the pump (9).

While the pump (9) is operating and there is flow in the hose (21), if the downstream communicating tube (63) is directed by a person wishing to sink the hose (21), to the downstream connection position (64) in the suction hose (21), then flow through the chamber (61) will be towards the connection position (64). This is owing to the fact that the pressure at the downstream connection position (64) will be lower than the pressure at the upstream connection position (62) by virtue of friction losses at the walls of the hose (21). Air in the chamber (61) will be flushed out into the hose (21) causing the hose (21) and attached chamber (61) to sink. The size of the connection (64) and the volume of the chamber (61) is such that the amount of air flowing into the hose (21) will be insufficient to significantly impair the operation of the filter pump.

Figure 9:
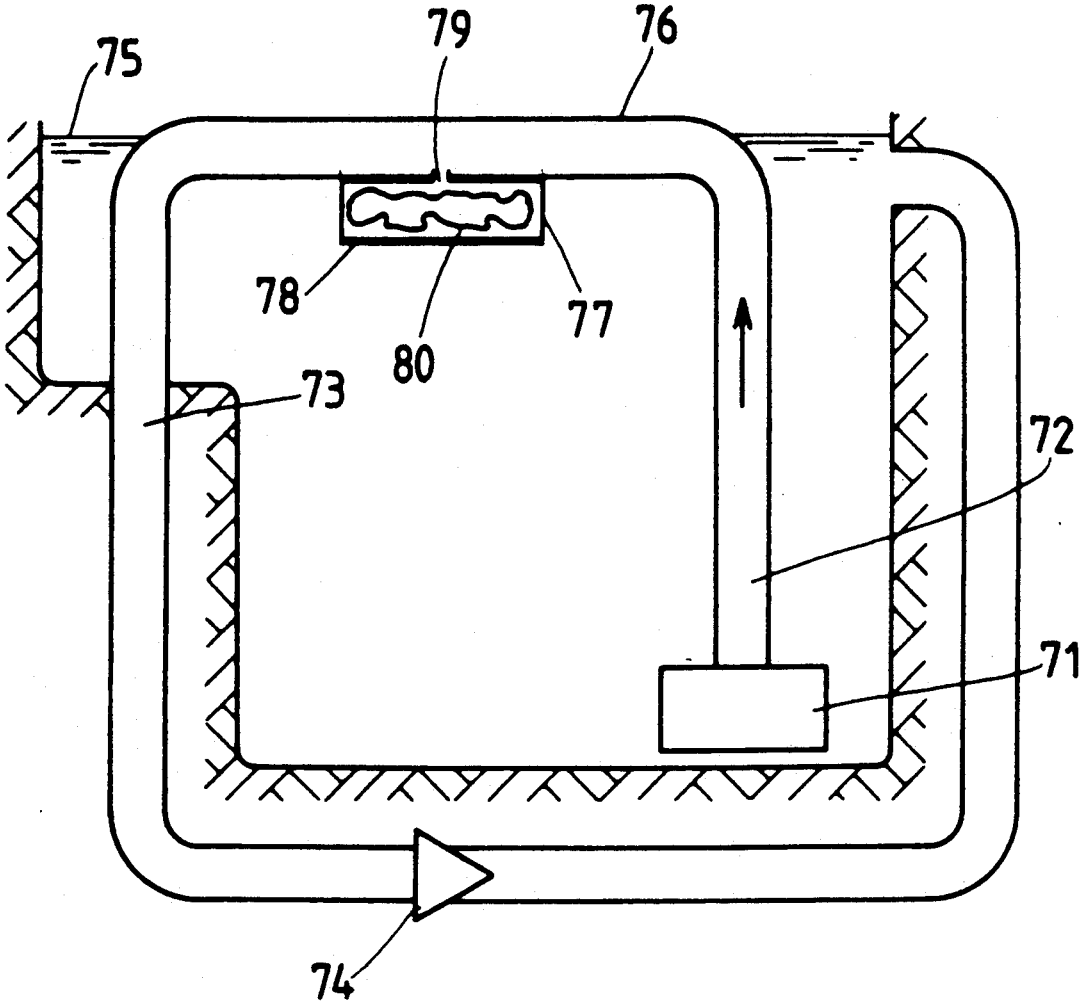
FIGS. 9 & 10 are diagrammatic functional views of further embodiments of the invention.

Referring to FIG. 9, a swimming pool cleaner suction head (71) is connected by a suction hose (72) to an inlet (73) to a filter pump (74) and is located in a swimming pool with a water level (75). The hose (72) for a section of its length runs along the surface in its conventional position (76) in use. Attached to the hose (72) is a rigid compartment (77) to which is attached a weight (78) and whose interior is connected to the interior of the main hose (72) via a connection (79). Located within the rigid compartment (77) is a sealed buoyancy bladder (80) containing a fixed mass of air.

If the pump is switched on and is connected to the main suction line (72), the pressure in this line (72) reduces. This pressure reduction is communicated to the rigid compartment (77) via the connection (79).

The pressure reduction in the weighted rigid compartment (77) causes an expansion of the buoyancy bladder (80) which allows water to leave the rigid compartment (77) via the connection (79). The rigid compartment (77) now has increased buoyancy which overcomes the downward force of the weighting (78) thereby causing the main suction line (72) to rise to the surface (75).

When the pump (74) is switched off or disconnected from the main suction hose (72), the pressure in the main suction line (72) rises, this rise being transmitted to the interior of the rigid compartment (77) via the connection (79). The subsequent increase in pressure on the walls of the buoyancy bladder (80) causes the bladder to shrink thereby allowing water to enter the rigid compartment (77), thereby reducing the buoyancy of this compartment and causing the hose (72) and compartment (77) assembly to sink.

Figure 10:
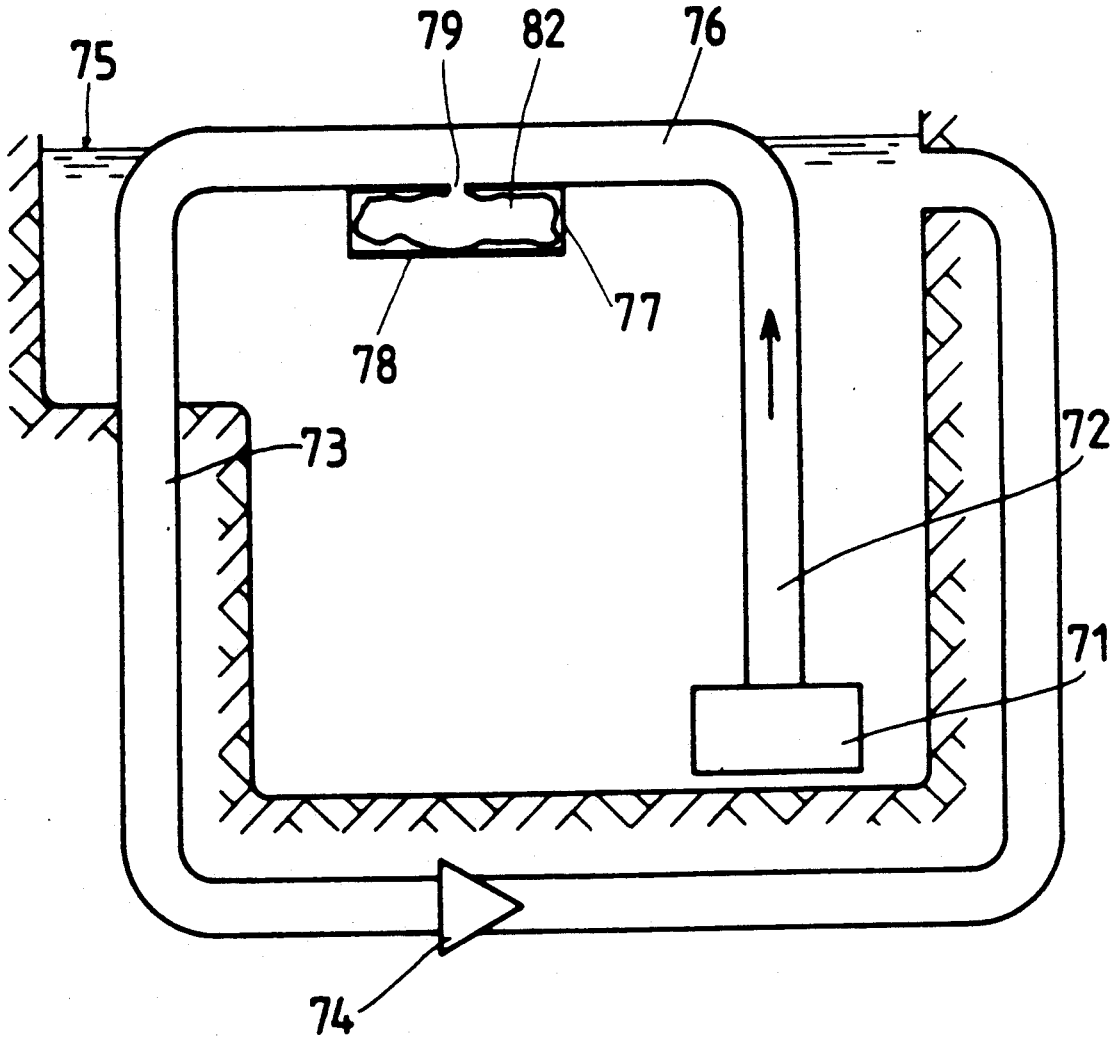

Referring now to FIG. 10, substantially the same embodiment as described with reference to FIG. 9 is shown. Like numerals in FIG. 10 indicate like components as described with reference to FIG. 9. In this case however, the compartment (77) is provided with a bladder (82) that is in communication with the interior of the hose through the connection (79), the compartment is otherwise sealed off, and is filled with air.

In use, the flow of water in the hose (76) will either contract or expand the bladder by causing a greater or lesser amount of water to be contained in it. This expansion and contraction of the bladder will cause a consequent decrease and increase respectively in the air volume contained in the rigid compartment (77).

It is considered that the invention provides a convenient method of sinking and raising a suction hose connected to a submerged suction head and furthermore of automatically sinking the suction hose when there is no flow through it.

What I claim as new and desire to secure by Letters Patent is

1. A method of raising and sinking a suction hose connected to a submerged suction head in a liquid, comprising providing a buoyancy compartment to the hose, weighting the hose to allow it to sink if the compartment buoyancy is reduced by reducing the volume of air therein, and to float if the compartment buoyancy is increased by increasing the volume of air therein, and, utilising the suction induced liquid flow in use in the hose to selectively cause a pressure differential to be applied to the compartment to alter its buoyancy by altering the volume of air therein and so selectively raise and sink the hose.

2. A method as claimed in claim 1 in which the buoyancy compartment is connected to the hose interior to cause variation in liquid flow in the hose to increase and reduce liquid pressure in the compartment and cause consequent contraction and expansion of the volume of an air filled bladder in the compartment to thereby alter its buoyancy.

3. A method as claimed in claim 1 in which the buoyancy compartment is filled with air and a bladder with liquid and the compartment is in communication with the hose interior, to allow liquid flow variations in the hose to expand and contract the bladder and consequently decrease and increase the air volume in the compartment to thereby alter its buoyancy.

4. A method as claimed in claim 1 in which the liquid flow causes the required pressure differential by the location of a variable volume buoyancy compartment in the length of the interior of the hose, with the compartment connected to atmosphere, and cutting off the liquid flow in the hose causes atmospheric pressure to be restored to the compartment allowing it to contract and the hose to sink, and allowing the reduced pressure caused during the liquid flow in the hose to expand the compartment and float the hose.

5. A method as claimed in claim 1 in which liquid flow causes the required pressure differential by the location of a variable volume buoyancy compartment in the length of the interior of the hose, with the compartment connected to atmosphere, and switching of the buoyancy compartment connection from atmosphere to the hose, at a position downstream of the compartment, is used to contract and expand the compartment and thereby sink and float the hose.

6. A method as claimed in claim 4 in which the cessation of liquid flow is caused by switching the suction pump off by operating a valve to divert the suction force of the pump from the hose.

7. A method as claimed in claim 5 in which switching of the compartment connection between the atmosphere and the suction hose is achieved by manual manipulation of a flexible breather hose with the connection of the breather hose position to the suction hose in both cases being provided with a valve or closure flap to seal the suction hose when not connected.

8. A method as claimed in claim 5 in which the switching of the buoyancy compartment connection between atmosphere and the hose is achieved by use of a valve means, which is automatically resettable to cause the hose to float when the suction flow is switched on after a period in which it was switched off.

9. A method as claimed in claim 8 in which a valve is located in the hose itself and operated against biasing to connect the compartment from atmosphere to the hose interior, with the pressure differential between atmosphere and hose interior holding the valve in this position, unless the liquid flow ceases, in which case the valve under biasing force remakes the connection from the hose interior to atmosphere, and refloats the hose once the liquid flow resumes thereafter.

10. An apparatus for raising and lowering a suction hose in a liquid, comprising:

a buoyancy compartment securable to the hose and having at least a first and a second state of buoyancy, the first and second buoyant states being determined by suction induced liquid flow through the hose; and hose weighting sufficient to lower the hose if the buoyancy compartment exhibits the first buoyant state and sufficient to raise the hose if the buoyancy compartment exhibits the second buoyant state.

11. The apparatus of claim 10 further comprising an air filled bladder housed within the buoyancy compartment whose volume contracts and expands in response to pressure caused by liquid flow through the buoyancy compartment, the contracted bladder causing the compartment to exhibit the first buoyancy state and the expanded bladder causing the compartment to exhibit the second buoyancy state.

12. The apparatus of claim 10 further comprising a bladder secured to the buoyancy compartment and in fluid communication with the hose, the bladder capable of expanding and contracting in response to fluid pressure caused by liquid flow through the hose, the expanded bladder causing the compartment to exhibit the first buoyancy state and the contracted bladder causing the compartment to exhibit the second buoyancy state.

13. The apparatus of claim 10 further comprising a flexible breather hose for selectively connecting a variable buoyancy compartment to atmosphere.

14. The apparatus of claim 13 wherein the flexible breather hose is adapted for selectively connecting the variable buoyancy compartment between atmosphere and the suction hose at a connection downstream of the compartment.

15. The apparatus of claim 14 wherein the downstream connection is a first valve for sealing the suction hose when the flexible breather hose is not connected therewith.

16. The apparatus of claim 15 wherein the valve is a closure flap.

17. The apparatus of claim 15 further comprising a second valve for switching the flexible breather hose between atmosphere and the suction hose, the second valve being automatically resettable to cause the variable buoyancy compartment to exhibit the second buoyant state when the liquid flow is commenced after a period in which there was substantially no liquid flow.

18. The apparatus of claim 17 wherein the second valve is located in the suction hose and is biased to connect the variable buoyancy compartment to atmosphere, the second valve capable of maintaining a connection between the variable buoyancy compartment and the downstream connection in response to fluid pressure caused by liquid flow through the suction hose, the second valve capable of remaking the connection between the compartment and atmosphere when the liquid flow ceases and refloating the suction hose when the liquid flow resumes.

* * * * *

UNITED STATES PATENT AND TRADEMARK OFFICE

CERTIFICATE OF CORRECTION

PATENT NO. : 5,029,600

DATED : July 9, 1991

INVENTOR(S) : Patrick M. McCullagh

It is certified that error appears in the above-identified patent and that said Letters Patent is hereby corrected as shown below:

In col. 4, line 1, delete "o" and insert --of--.
In col. 5, line 35, after "flotation chamber," insert --(61)--.

Signed and Sealed this

Thirteenth Day of October, 1992

*Attest:*

DOUGLAS B. COMER

*Attesting Officer*

*Acting Commissioner of Patents and Trademarks*